US007358979B2

(12) United States Patent
Toriumi et al.

(10) Patent No.: US 7,358,979 B2
(45) Date of Patent: *Apr. 15, 2008

(54) DISPLAY DRIVER AND ELECTRO-OPTICAL DEVICE

(75) Inventors: Yuichi Toriumi, Chino (JP); Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 830 days.

This patent is subject to a terminal disclaimer.

(21) Appl. No.: 10/760,702

(22) Filed: Jan. 21, 2004

(65) Prior Publication Data

US 2004/0212631 A1 Oct. 28, 2004

(30) Foreign Application Priority Data

Jan. 31, 2003 (JP) ..... 2003-023670

(51) Int. Cl.
*G09G 5/10* (2006.01)

(52) U.S. Cl. ..... 345/690; 345/100

(58) Field of Classification Search ..... 345/88–100, 345/690.698

See application file for complete search history.

(56) References Cited

U.S. PATENT DOCUMENTS 6,130,657 A * 10/2000 Kurokawa et al. ..... 345/100
6,621,481 B1 * 9/2003 Kanbara ..... 345/100
6,750,835 B2 * 6/2004 Azami ..... 345/89
6,909,418 B2 * 6/2005 Arai ..... 345/98
2003/0030614 A1 * 2/2003 Tajima et al. ..... 345/89

FOREIGN PATENT DOCUMENTS

| | | |
|---|---|---|
| JP | A 3-285479 | 12/1991 |
| JP | A 2001-51656 | 2/2001 |
| JP | A 2002-156654 | 5/2002 |

OTHER PUBLICATIONS

U.S. Appl. No. 10/754,554, filed Jan. 12, 2004, Toriumi et al.

* cited by examiner

*Primary Examiner*—Amr A. Awad
*Assistant Examiner*—Dennis P. Joseph
(74) *Attorney, Agent, or Firm*—Oliff & Berridge, PLC

(57) ABSTRACT

A comb-tooth drive is realized by using a display driver which drives data lines. The display driver includes: a gray-scale bus to which gray-scale data is supplied corresponding to an arrangement order of each of the data lines; first and second clock lines to which first and second shift clocks are supplied; first and second shift registers which shift first and second shift start signals in first and second shift directions based on the first and second shift clocks, respectively; first and second data latches which latch the gray-scale data based on the shift outputs of the first and second shift registers, respectively; and a data line driver circuit which drives the data lines based on the data latched by the first and second data latches.

20 Claims, 14 Drawing Sheets

DISPLAY DRIVER AND ELECTRO-OPTICAL DEVICE

Japanese Patent Application No. 2003-23670 filed on Jan. 31, 2003, is hereby incorporated by reference in its entirety.

BACKGROUND OF THE INVENTION

The present invention relates to a display driver and an electro-optical device.

A display panel (display device in a broad sense) represented by a liquid crystal display (LCD) panel is mounted on portable telephones and personal digital assistants (PDAs). In particular, an LCD panel realizes reduction of the size, power consumption, and cost in comparison with other display panels, and is mounted on various electronic instruments.

An LCD panel is required to have a size equal to or greater than a certain size taking visibility of a display image into consideration. On the other hand, there has been a demand that the mounting size of the LCD panel be as small as possible when the LCD panel is mounted on electronic instruments.

BRIEF SUMMARY OF THE INVENTION

One aspect of the present invention relates to a display driver which drives a plurality of data lines of an electro-optical device which includes a plurality of scan lines, the data lines, a switching element connected with one of the scan lines and one of the data lines and a pixel electrode connected with the switching element, the data lines including data line groups alternately distributed from two opposite sides toward inside of the electro-optical device in a shape of comb teeth, each of the data line groups consisting of a predetermined number of the data lines, and the display driver including:

a gray-scale bus to which gray-scale data is supplied corresponding to an arrangement order of each of the data lines;

first and second clock lines to which a first and second shift clocks are supplied;

a first shift register which includes a plurality of flip-flops, shifts a first shift start signal in a first shift direction based on the first shift clock, and outputs shift output from each of the flip-flops;

a second shift register which includes a plurality of flip-flops, shifts a second shift start signal in a second shift direction opposite to the first shift direction based on the second shift clock, and outputs shift output from each of the flip-flops;

a first data latch which includes a plurality of flip-flops, each of which holds the gray-scale data corresponding to one of the data lines based on the shift output of the first shift register;

a second data latch which includes a plurality of flip-flops, each of which holds the gray-scale data corresponding to one of the data lines based on the shift output of the second shift register; and a data line driver circuit including a plurality of data output sections, each of the data output sections driving one of the data lines based on the gray-scale data held in one of the flip-flops of the first or second data latch and being disposed corresponding to the arrangement order of the data lines.

DETAILED DESCRIPTION OF THE EMBODIMENT

Embodiments of the present invention are described below. Note that the embodiments described hereunder do not in any way limit the scope of the invention defined by the claims laid out herein. Note also that all of the elements described below should not be taken as essential requirements for the present invention.

As an LCD panel which allows the mounting size to be reduced, a so-called comb-tooth distributed LCD panel has been known.

In order to reduce the mounting size of the LCD panel, it is effective to reduce the interconnect region between the LCD panel and a scanning driver which drives scan lines of the LCD panel, or to reduce the interconnect region between the LCD panel and a display driver which drives data lines of the LCD panel.

In the case where a display driver drives data lines of a comb-tooth distributed LCD panel from opposite sides of the LCD panel, the order of gray-scale data supplied corresponding to the arrangement order of data lines in a conventional LCD panel must be changed.

Since a conventional display driver cannot change the order of gray-scale data supplied corresponding to each data line, a dedicated data scramble IC must be added in the case of driving the comb-tooth distributed LCD panel by using a conventional display driver.

According to the following embodiments, a display driver and an electro-optical device capable of driving a display panel in which data lines are comb-tooth distributed without providing an additional circuit can be provided.

The embodiments of the present invention are described below in detail with reference to the drawings.

1. Electro-optical device

Figure 1:
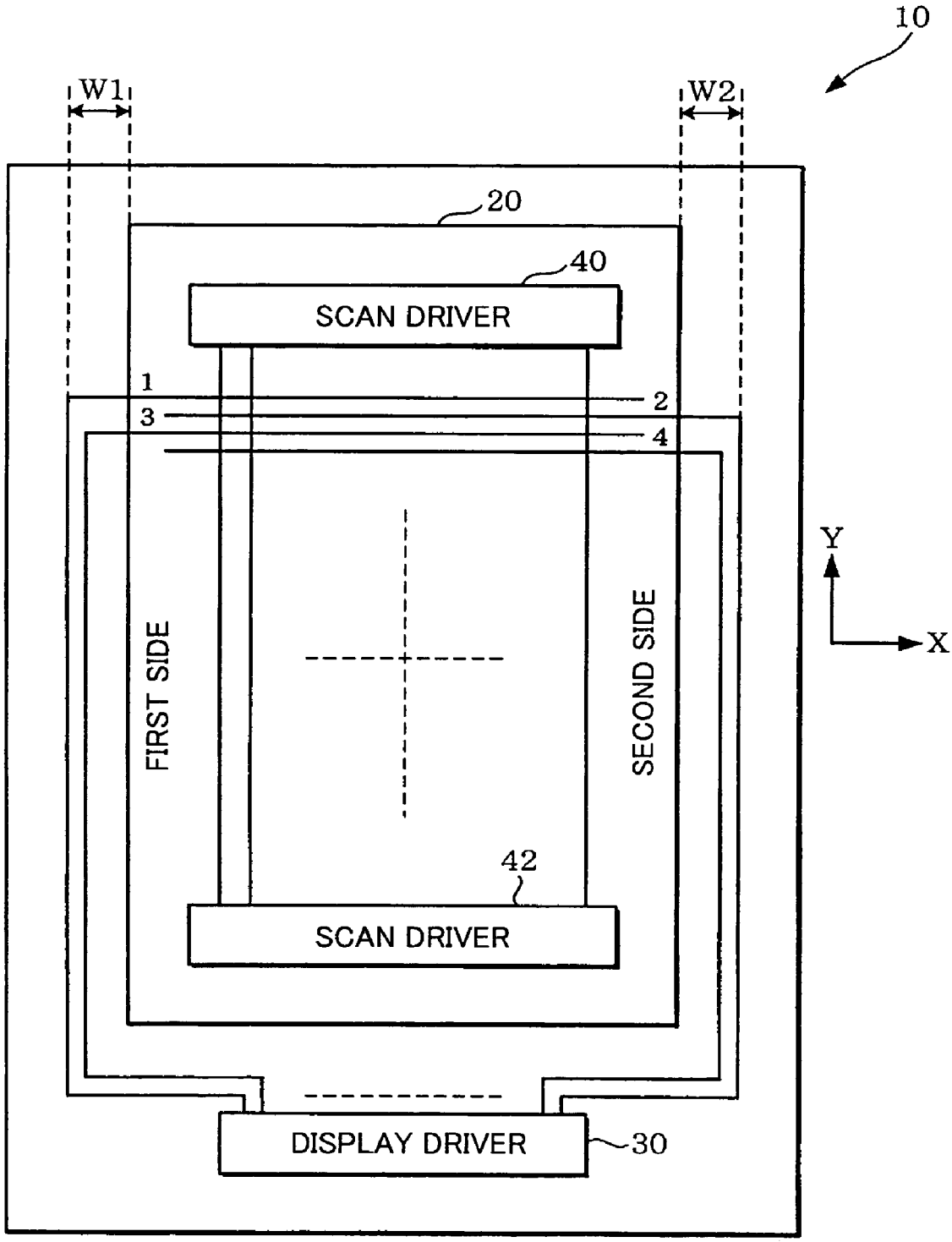
FIG. 1 is a block diagram schematically showing a configuration of an electro-optical device in an embodiment of the present invention.

FIG. 1 shows an outline of a configuration of an electro-optical device in this embodiment. FIG. 1 shows a liquid crystal device as an example of an electro-optical device. A liquid crystal device may be incorporated in various electronic instruments such as a portable telephone, portable information instrument (PDA, etc.), digital camera, projector, portable audio player, mass storage device, video camera, electronic notebook, or global positioning system (GPS).

A liquid crystal device 10 includes an LCD panel (display panel in a broad sense; electro-optical device in a broader sense) 20, a display driver (source driver) 30, and scanning drivers (gate drivers) 40 and 42.

The liquid crystal device 10 does not necessarily include all of these circuit blocks. The liquid crystal device 10 may have a configuration in which some of these circuit blocks are omitted.

The liquid crystal panel 20 includes a plurality of scan lines (gate lines), a plurality of data lines (source lines) which intersect the scan lines, and a plurality of pixels, each of the pixels being specified by one of the scan lines and one of the data lines. In the case where one pixel consists of three color components of RGB, one pixel consists of three dots, one dot each for red, green, and blue. The dot may be referred to as an element point which makes up each pixel. The data lines corresponding to one pixel may be referred to as data lines of the number of color components which make up one pixel. The following description is given on the assumption that one pixel consists of one dot for convenience of description.

Each of the pixels includes a thin film transistor (hereinafter abbreviated as "TFT") (switching element) and a pixel electrode. The TFT is connected with the data line, and the pixel electrode is connected with the TFT.

The LCD panel 20 is formed on a panel substrate formed of a glass substrate, for example. A plurality of scan lines, arranged in the X direction shown in FIG. 1 and extending in the Y direction, and a plurality of data lines, arranged in the Y direction and extending in the X direction, are disposed on the panel substrate. In the LCD panel 20, the data lines are comb-tooth distributed. In FIG. 1, the data lines are comb-tooth distributed so as to be driven from a first side of the LCD panel 20 and a second side which faces the first side. The comb-tooth distribution may be referred to as distribution in which a given number of data lines (one or a plurality of data lines) are alternately distributed from each side (first and second sides of the LCD panel 20) toward the inside in the shape of comb teeth.

Figure 2:
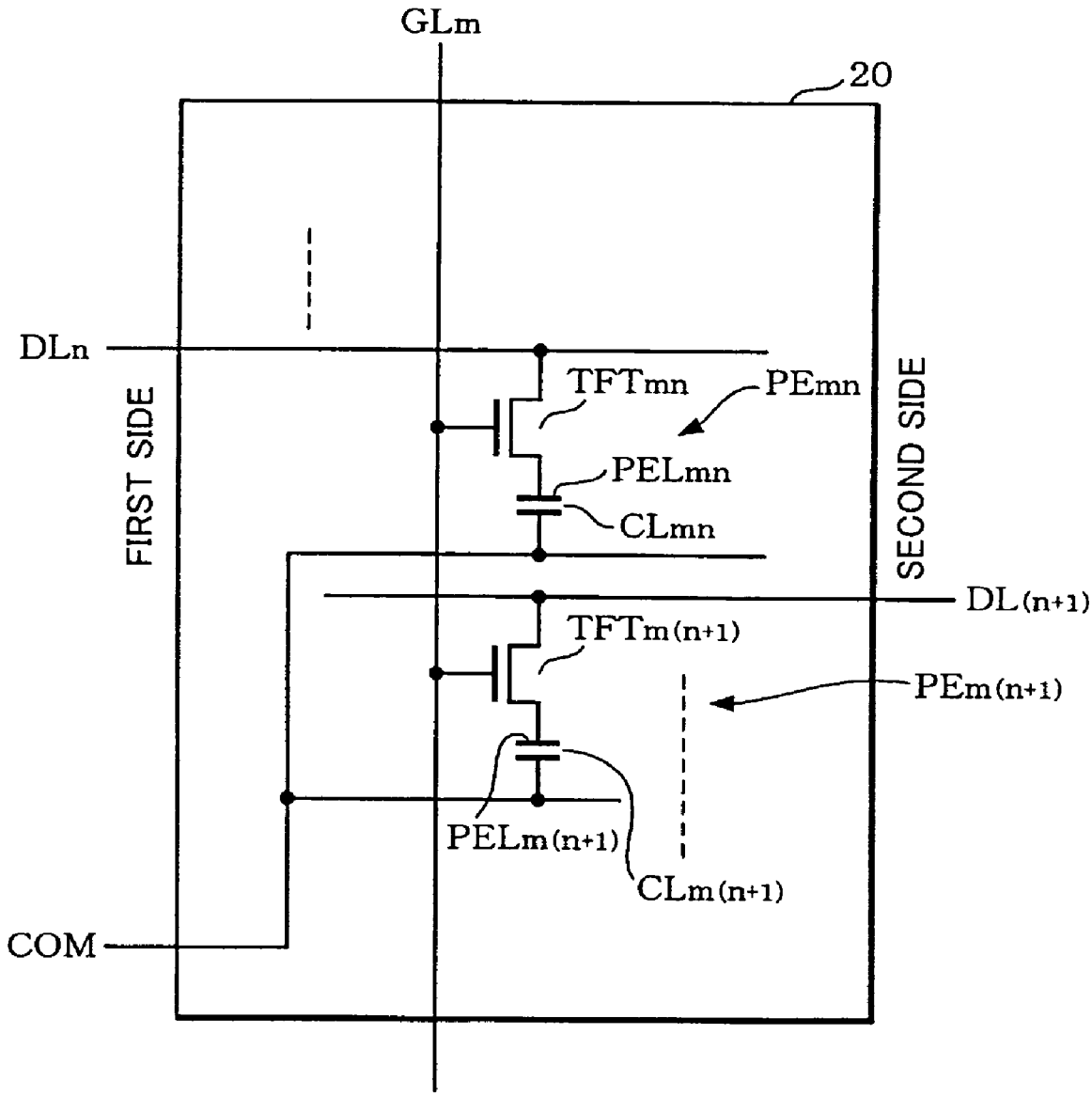
FIG. 2 is a schematic diagram showing a configuration of a pixel in an embodiment of the present invention.

FIG. 2 schematically shows a configuration of the pixel. In FIG. 2, one pixel consists of one dot. A pixel PEmn is disposed at a location corresponding to the intersecting point of the scan line GLm ($1 \leqq m \leqq M$, M and m are integers) and the data line DLn ($1 \leqq n \leqq N$, N and n are integers). The pixel PEmn includes the TFTmn and the pixel electrode PELmn.

A gate electrode of the TFTmn is connected with the scan line GLm. A source electrode of the TFTmn is connected with the data line DLn. A drain electrode of the TFTmn is connected with the pixel electrode PELmn. A liquid crystal capacitor CLmn is formed between the pixel electrode and a common electrode COM which faces the pixel electrode through a liquid crystal element (electro-optical material in a broad sense). A storage capacitor may be formed in parallel with the liquid crystal capacitor CLmn. Transmissivity of the pixel changes corresponding to the voltage applied between the pixel electrode and the common electrode COM. A voltage VCOM supplied to the common electrode COM is generated by a power supply circuit (not shown).

The LCD panel 20 is formed by attaching a first substrate on which the pixel electrode and the TFT are formed to a second substrate on which the common electrode is formed, and sealing a liquid crystal as an electro-optical material between the two substrates.

The scan line is scanned by the scanning drivers 40 and 42. In FIG. 1, one scan line is driven by the scanning drivers 40 and 42 at the same time.

The data line is driven by the display driver 30. The data line is driven by the display driver 30 from the first side of the LCD panel 20 or the second side of the LCD panel 20 which faces the first side. The first and second sides of the LCD panel 20 face in the direction in which the data lines extend.

In the LCD panel 20 in which the data lines are comb-tooth distributed, the data lines are comb-tooth distributed so that the data lines of the number of color components of each pixel disposed corresponding to the adjacent pixels connected with the selected scan line are driven from opposite directions.

In more detail, in the LCD panel 20 in which the data lines are comb-tooth distributed in FIG. 2, in the case where the data lines DLn and DL(n+1) are disposed corresponding to the adjacent pixels connected with the selected scan line GLm, the data line DLn is driven by the display driver 30 from the first side of the LCD panel 20, and the data line DL(n+1) is driven by the display driver 30 from the second side of the LCD panel 20.

This also applies to the case where the data lines corresponding to each color component of RGB are disposed corresponding to one pixel. In this case, if the data line DLn consisting of a set of three color component data lines (Rn, Gn, Bn) and the data line DL(n+1) consisting of a set of three color component data lines (R(n+1), G(n+1), B(n+1)) are disposed corresponding to the adjacent pixels connected with the selected scan line GLm, the data line DLn is driven by the display driver 30 from the first side of the LCD panel 20, and the data line DL(n+1) is driven by the display driver 30 from the second side of the LCD panel 20.

The display driver 30 drives the data lines DL1 to DLN of the LCD panel 20 based on gray-scale data for one horizontal scanning period supplied in units of horizontal scanning periods. In more detail, the display driver 30 drives at least one of the data lines DL1 to DLN based on the gray-scale data.

The scanning drivers 40 and 42 drive the scan lines GL1 to GLM of the LCD panel 20. In more detail, the scanning drivers 40 and 42 consecutively select the scan lines GL1 to GLM in one vertical period, and drive the selected scan line.

The display driver 30 and the scanning drivers 40 and 42 are controlled by a controller (not shown). The controller outputs control signals to the display driver 30, the scanning drivers 40 and 42, and the power supply circuit according to the contents set by a host such as a central processing unit (CPU). In more detail, the controller supplies an operation mode setting and a horizontal synchronization signal or a vertical synchronization signal generated therein to the display driver 30 and the scanning drivers 40 and 42, for example. The horizontal synchronization signal specifies the horizontal scanning period. The vertical synchronization signal specifies the vertical scanning period. The controller controls the power supply circuit relating to polarity reversal timing of the voltage VCOM applied to the common electrode COM.

The power supply circuit generates various voltages applied to the LCD panel 20 and the voltage VCOM applied to the common electrode COM based on a reference voltage supplied from the outside.

In FIG. 1, the liquid crystal device 10 may include the controller, or the controller may be provided outside the liquid crystal device 10. The host (not shown) may be included in the liquid crystal device 10 together with the controller.

At least one of the scanning drivers 40 and 42, the controller, and the power supply circuit may be included in the display driver 30.

Some or all of the display driver 30, the scanning drivers 40 and 42, the controller, and the power supply circuit may be formed on the LCD panel 20. For example, the display driver 30 and the scanning drivers 40 and 42 may be formed on the LCD panel 20. In this case, the LCD panel 20 may be called an electro-optical device. The LCD panel 20 may be formed to include the data lines, the scan lines, the pixels, each of which is specified by one of the data lines and one of the scan lines, the display driver which drives the data lines, and the scanning drivers which scan the scan line. The pixels are formed in a pixel formation region of the LCD panel 20.

The advantages of the comb-tooth distributed LCD panel are described below.

Figure 3:
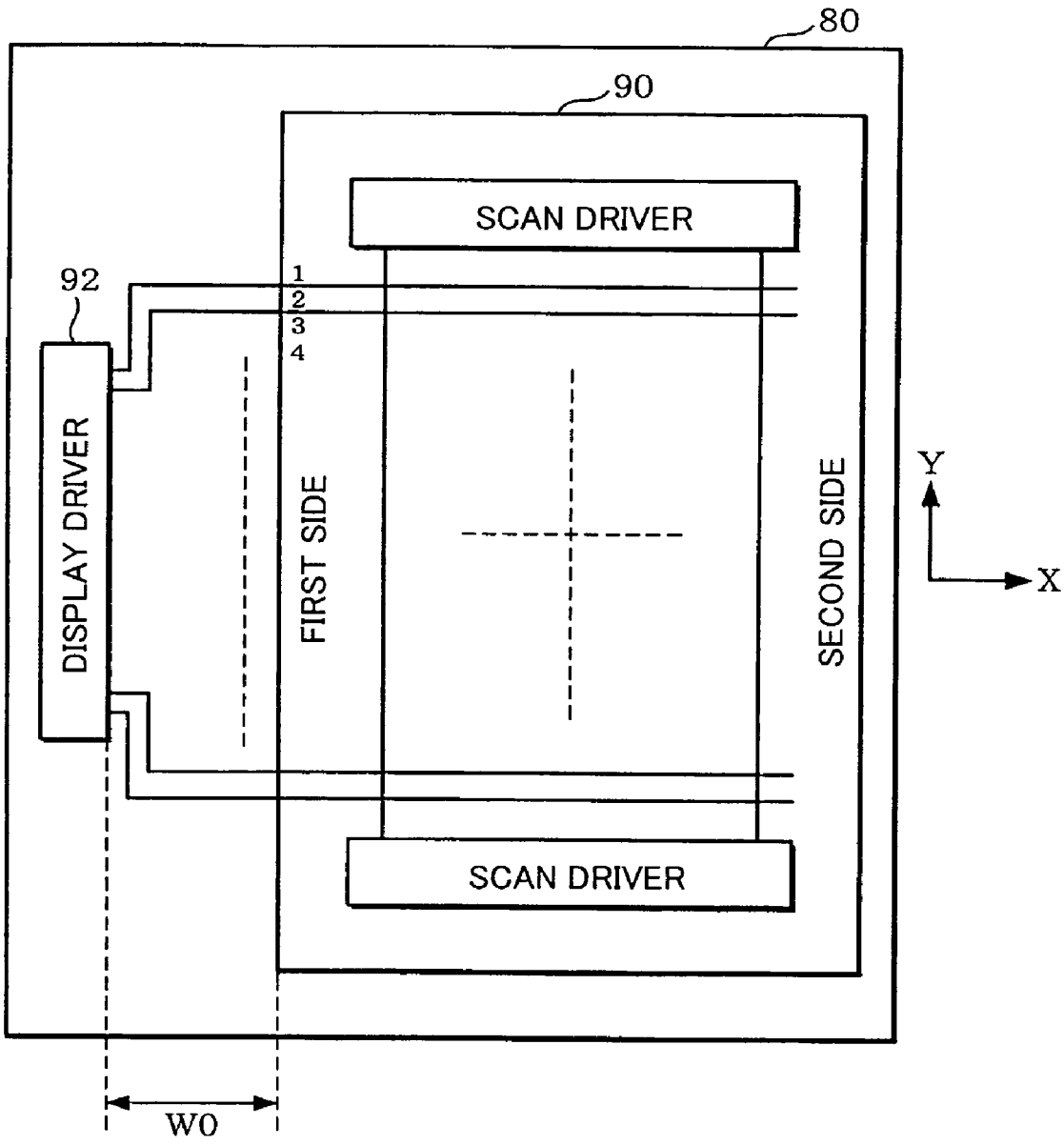
FIG. 3 is a block diagram schematically showing a configuration of an electro-optical device including an LCD panel which is not comb-tooth distributed.

FIG. 3 schematically shows a configuration of an electro-optical device including an LCD panel which is not comb-tooth distributed. An electro-optical device 80 shown in FIG. 3 includes an LCD panel 90 which is not comb-tooth distributed. In the LCD panel 90, each of the data lines is driven by a display driver 92 from a first side. Therefore, an interconnect region for connecting each of data output sections of the display driver 92 with each of the data lines of the LCD panel 90 is necessary. If the number of data lines is increased and the lengths of the first and second sides of the LCD panel 90 are increased, it is necessary to bend each interconnect, whereby the width W0 is necessary for the interconnect region.

On the contrary, in the electro-optical device 10 shown in FIG. 1, only the widths W1 and W2 which are smaller than the width W0 are necessary on the first and second sides of the LCD panel 20.

Taking mounting on electronic instruments into consideration, an increase in the length of the LCD panel (electro-optical device) in the direction of the short side is inconvenient in comparison with the case where the length of the LCD panel is increased in the direction of the long side to some extent. This is not desirable from the viewpoint of the design, since the width of the frame of the display section of the electronic instrument is increased, for example.

In FIG. 3, the length of the LCD panel is increased in the direction of the short side. In FIG. 1, the length of the LCD panel is increased in the direction of the long side. Therefore, the widths of the interconnect regions on the first and second sides can be made narrow to almost an equal extent. In FIG. 1, the area of the non-interconnect region in FIG. 3 can be reduced, whereby the mounting size can be reduced.

Figure 4:
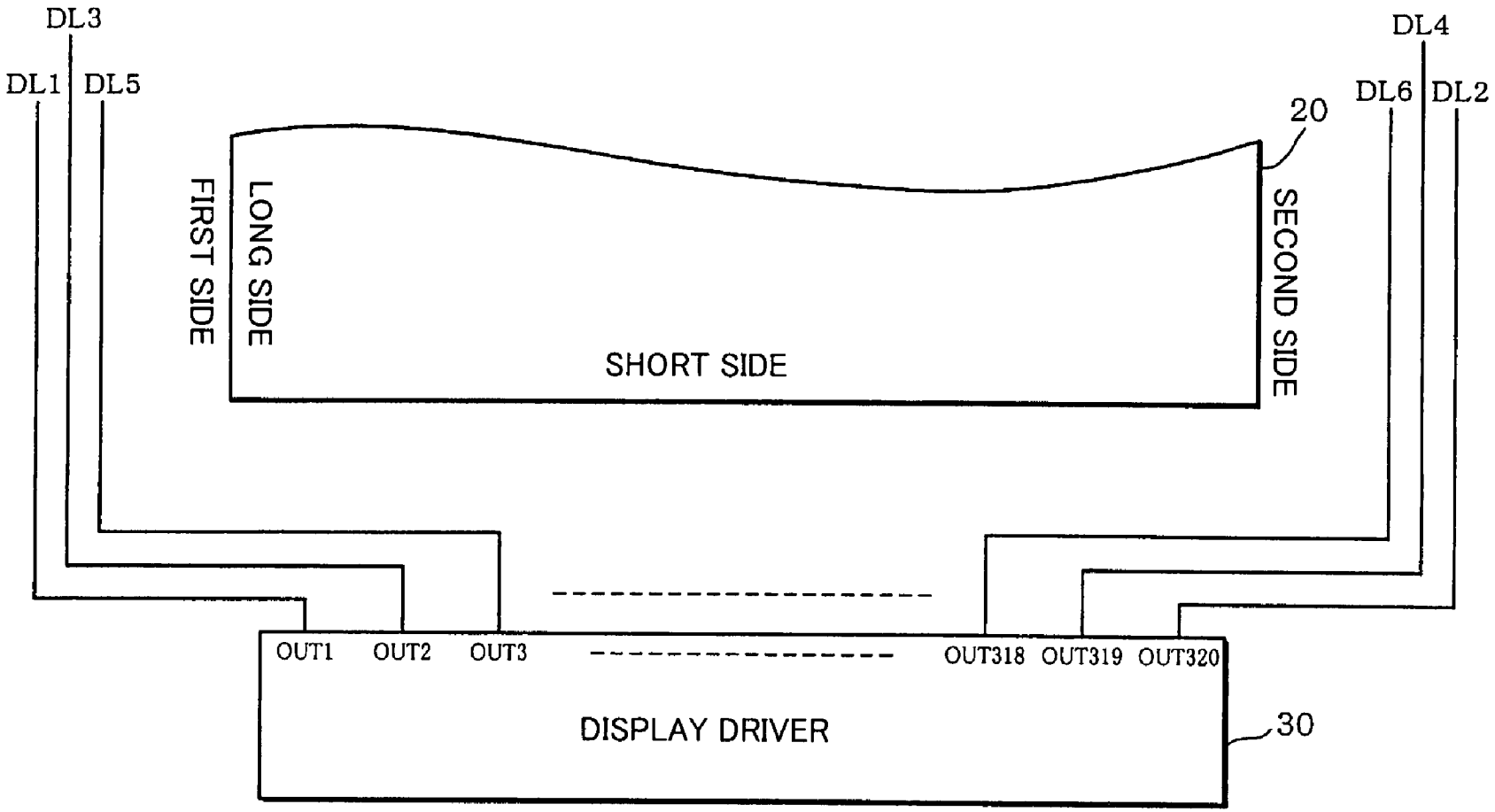
FIG. 4 is a diagram illustrating an example of a display driver disposed along the short side of an LCD panel.

In the case where the arrangement order of the data output sections of the display driver 30 corresponds to the arrangement order of the data lines of the LCD panel 20, the interconnects which connect the data output sections with the data lines can be disposed from the first and second sides by disposing the display driver 30 along the short side of the LCD panel 20 as shown in FIG. 4, whereby the interconnects can be simplified and the interconnect region can be reduced.

However, in the display driver 30 which receives gray-scale data output by a general-purpose controller corresponding to the arrangement order of the data lines, it is necessary to change the order of the received gray-scale data in the case of driving the LCD panel 20.

The following description is given on the assumption that the display driver 30 includes data output sections OUT1 to OUT320, and the data output sections are arranged in the direction from the first side to the second side. Each of the data output sections corresponds to each of the data lines of the LCD panel 20.

Figure 5:
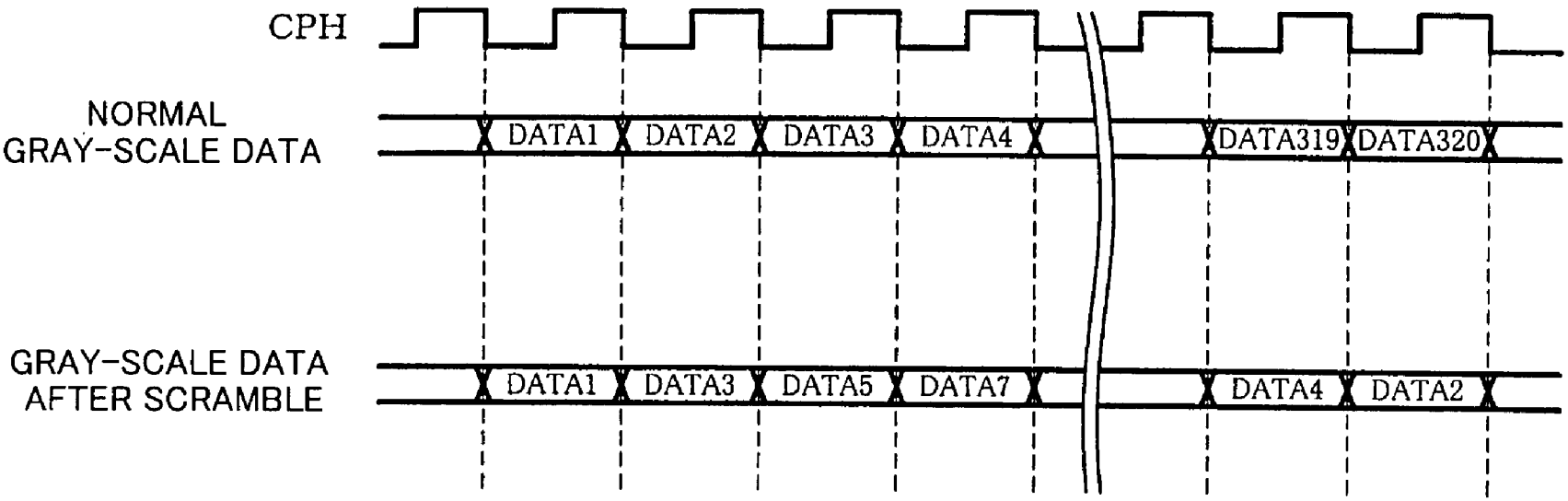
FIG. 5 is illustrative of the necessity of data scramble for driving a comb-tooth distributed LCD panel.

A general-purpose controller supplies gray-scale data DATA1 to DATA320 respectively corresponding to the data lines DL1 to DL320 to the display driver 30 in synchronization with a reference clock CPH, as shown in FIG. 5. In the case where the display driver 30 drives the LCD panel shown in FIG. 3 which is not comb-tooth distributed, since the data output section OUT1 is connected with the data line DL1, the data output section OUT2 is connected with the data line DL2, . . . , and the data output section OUT320 is connected with the data line DL320, an image can be displayed without causing a problem. However, in the case where the display driver 30 drives the comb-tooth distributed LCD panel as shown in FIG. 1 or 4, since the data output section OUT1 is connected with the data line DL1, the data output section OUT2 is connected with the data line DL3, . . . , and the data output section OUT320 is connected with the data line DL2, a desired image cannot be displayed.

Therefore, it is necessary to change the arrangement of the gray-scale data as shown in FIG. 5 by performing scramble processing which changes the order of the gray-scale data. Therefore, in the case of driving the comb-tooth distributed LCD panel by using a display driver controlled by a general-purpose controller, a dedicated data scramble IC which performs the above scramble processing is added, whereby the mounting size is inevitably increased.

The display driver 30 in this embodiment is capable of driving the comb-tooth distributed LCD panel based on the gray-scale data supplied from a general-purpose controller by using the configuration described below.

2. Display driver

Figure 6:
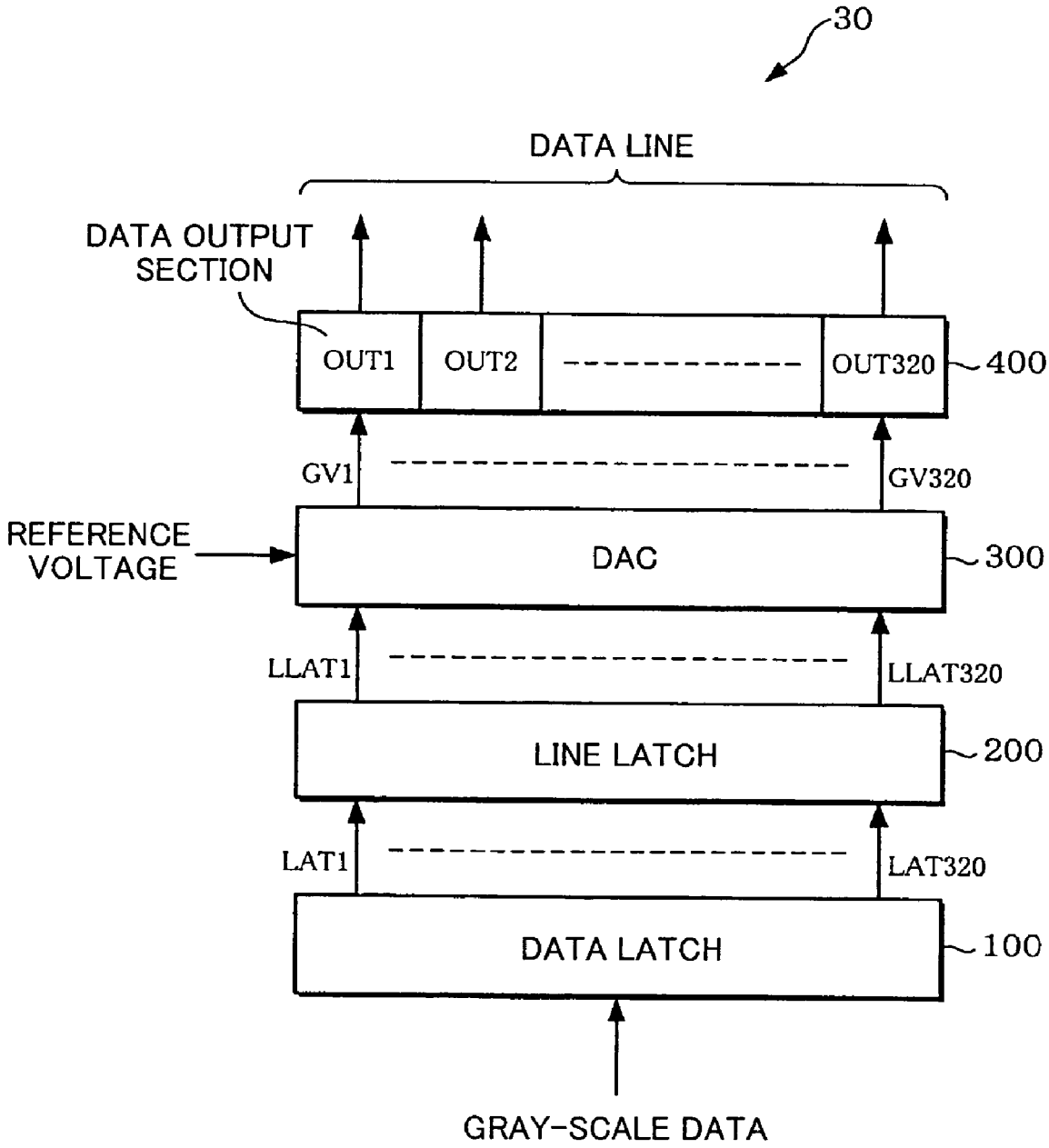
FIG. 6 is a block diagram schematically showing a configuration of a display driver in an embodiment of the present invention.

FIG. 6 shows an outline of a configuration of the display driver 30. The display driver 30 includes a data latch 100, a line latch 200, a digital-to-analog converter (DAC) (voltage select circuit in a broad sense) 300, and a data line driver circuit 400.

The data latch 100 captures the gray-scale data in one horizontal scanning cycle.

The line latch 200 latches the gray-scale data captured by the data latch 100 based on the horizontal synchronization signal Hsync.

The DAC 300 selectively outputs the drive voltage (gray-scale voltage) corresponding to the gray-scale data from the line latch 200 in units of data lines from a plurality of reference voltages corresponding to the gray-scale data. In more detail, the DAC 300 decodes the gray-scale data from the line latch 200, and selects one of the reference voltages based on the decode result. The reference voltage selected by the DAC 300 is output to the data line driver circuit 400 as the drive voltage.

The data line driver circuit 400 includes 320 data output sections OUT1 to OUT320. The data line driver circuit 400 drives the data lines DL to DLN based on the drive voltage from the DAC 300 through the data output sections OUT1 to OUT320. In the data line driver circuit 400, the data output sections (OUT1 to OUT320), each of which drives each of the data lines based on the gray-scale data (latch data) held in the line latch 200 (flip-flop of first or second data latch), are disposed corresponding to the arrangement order of the data lines. The above description illustrates the case where the data line driver circuit 400 includes the 320 data output sections OUT1 to OUT320. However, the number of data output sections is not limited.

In the display driver 30, latch data LAT1 captured by the data latch 100 is output to the line latch 200. The latch data LLAT1 latched by the line latch 200 is output to the DAC 300. The DAC 300 generates a drive voltage GV1 corresponding to the latch data LLAT1 from the line latch 200. The data output section OUT1 of the data line driver circuit 400 drives the data line connected with the data output section OUT1 based on the drive voltage GV1 from the DAC 300.

As described above, the display driver 30 captures the gray-scale data into the data latch 100 in units of data output sections of the data line driver circuit 400. The latch data latched by the data latch 100 in units of data output sections may be in units of one pixel, a plurality of pixels, one dot, or a plurality of dots.

Figure 7:
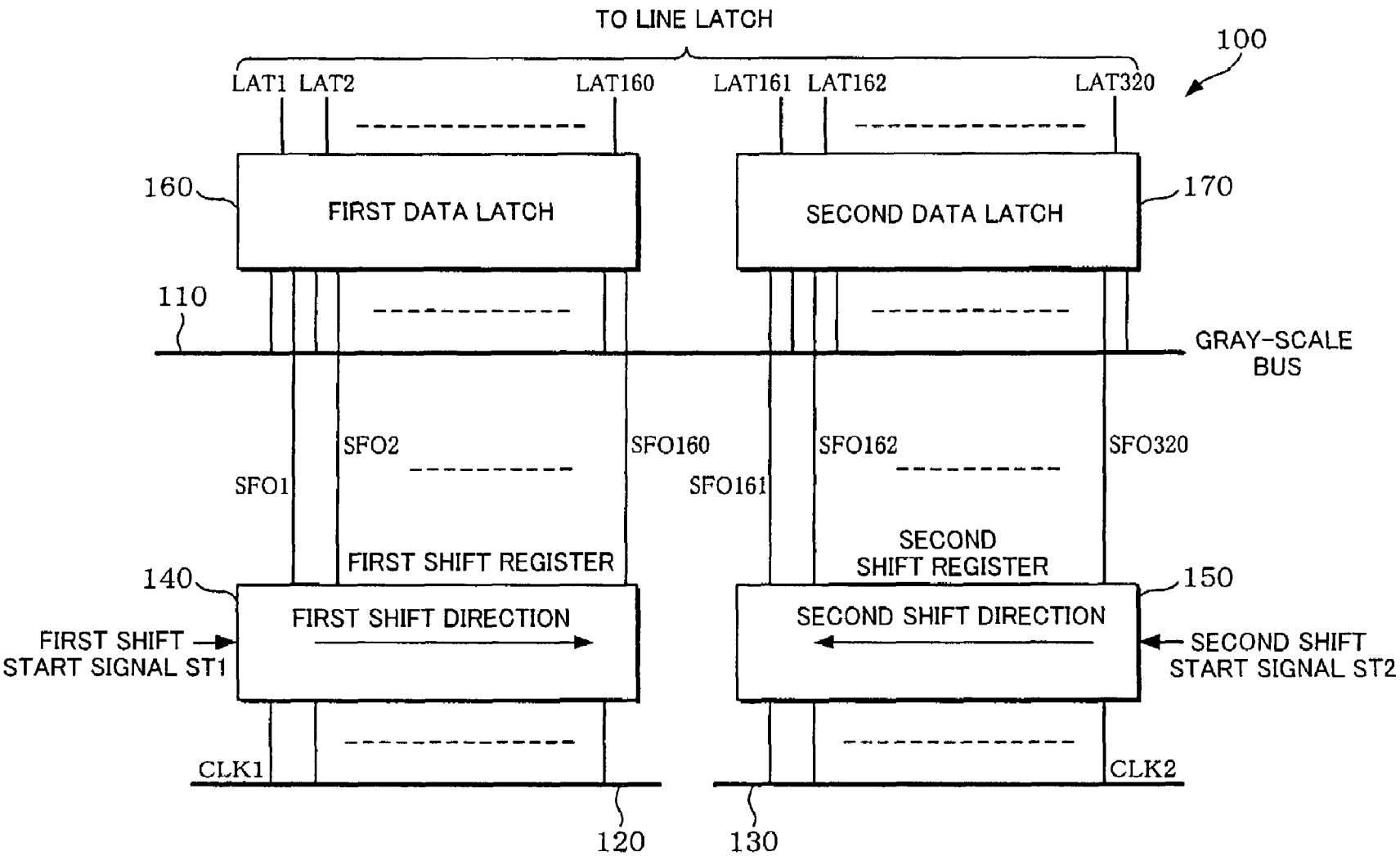
FIG. 7 is a block diagram schematically showing a configuration of a data latch shown in FIG. 6.

FIG. 7 shows an outline of a configuration of the data latch 100 shown in FIG. 6. The data latch 100 includes a gray-scale bus 110, first and second clock lines 120 and 130, first and second shift registers 140 and 150, and first and second data latches 160 and 170.

The gray-scale data is supplied to the gray-scale bus 110 corresponding to the arrangement order of the data lines DL1 to DLN. A first shift clock CLK1 is supplied to the first clock line 120. A second shift clock CLK2 is supplied to the second clock line 130.

The first shift register 140 includes a plurality of flip-flops. The first shift register 140 shifts a first shift start signal ST1 in a first shift direction based on the first shift clock CLK1, and outputs shift outputs from each flip-flop. The first shift direction may be the direction from the first side to the second side of the LCD panel 20. Shift outputs SFO1 to SFO160 of the first shift register 140 are output to the first data latch 160.

Figure 8:
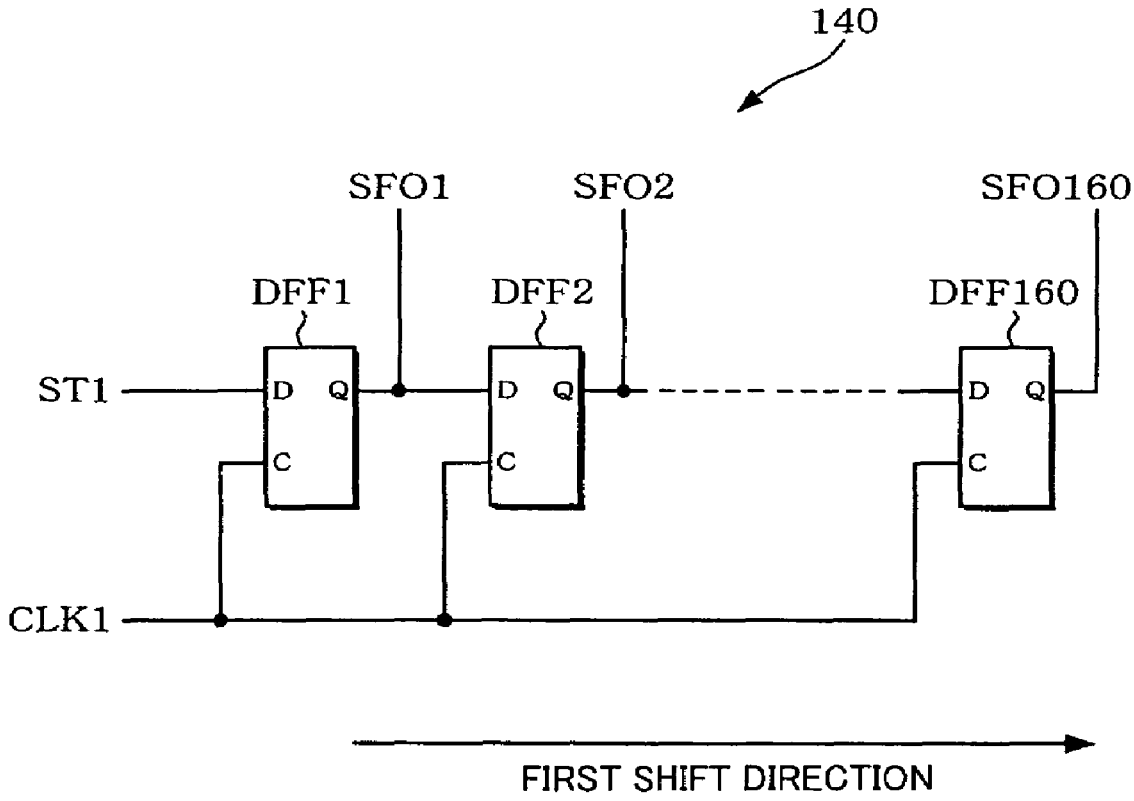
FIG. 8 is a circuit diagram showing a configuration example of a first shift register.

FIG. 8 shows a configuration example of the first shift register 140. In the first shift register 140, D flip-flops (hereinafter abbreviated as "DFF") DFF1 to DFF160 are connected in series so that the first shift start signal ST1 is shifted in the first shift direction. A Q terminal of the DFFk ($1 \leqq k \leqq 159$, k is a natural number) is connected with a D terminal of the DFF(k+1) in the subsequent stage. Each of the DFFs captures and holds the signal input to the D terminal at a rising edge of the signal input to a C terminal, and outputs the held signal from the Q terminal as the shift output SFO.

In FIG. 7, the second shift register 150 includes a plurality of flip-flops. The second shift register 150 shifts a second shift start signal ST2 in a second shift direction opposite to the first direction based on the second shift clock CLK2, and outputs shift outputs from each flip-flop. The second shift direction may be the direction from the second side to the first side of the LCD panel 20. Shift outputs SFO161 to SFO320 of the second shift register 150 are output to the second data latch 170.

Figure 9:
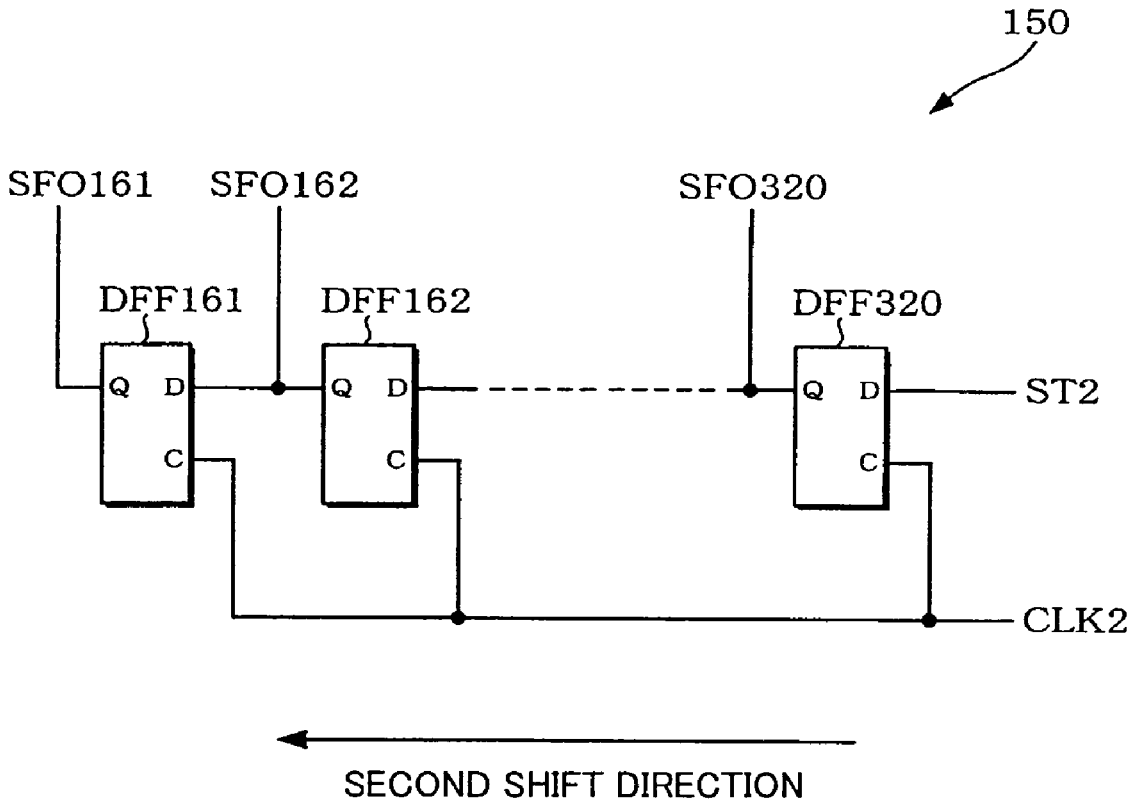
FIG. 9 is a circuit diagram showing a configuration example of a second shift register.

FIG. 9 shows a configuration example of the second shift register 150. In the second shift register 150, DFF320 to DFF161 are connected in series so that the second shift start signal ST2 is shifted in the second shift direction. A Q terminal of the DFFj ($162 \leqq j \leqq 320$, j is a natural number) is connected with a D terminal of the DFFj−1) in the subsequent stage. Each of the DFFs captures and holds the signal input to the D terminal at a rising edge of the signal input to a C terminal, and outputs the held signal from the Q terminal as the shift output SFO.

In FIG. 7, the first data latch 160 includes a plurality of flip-flops (FF) 1 to 160 (not shown), each of which corresponds to one of the data output sections OUT1 to OUT160. The FFi ($1 \leqq i \leqq 160$) holds the gray-scale data on the gray-scale bus 110 based on the shift output SFOi of the first shift register 140. The gray-scale data held in the flip-flops of the first data latch 160 is output to the line latch 200 as the latch data LAT1 to LAT160.

The second data latch 170 includes a plurality of flip-flops (FF) 161 to 320 (not shown), each of which corresponds to one of the data output sections OUT161 to OUT320. The FFi ($161 \leqq i \leqq 320$) holds the gray-scale data on the gray-scale bus 110 based on the shift output SFOi of the second shift register 150. The gray-scale data held in the flip-flops of the second data latch 170 is output to the line latch 200 as the latch data LAT161 to LAT320.

As described above, the first and second data latches 160 and 170 are capable of capturing the gray-scale data on the gray-scale bus 110 connected in common based on the shift outputs which can be separately generated. This enables the latch data corresponding to each of the data output sections to be captured into the data latch 100 by changing the arrangement order of the gray-scale data on the gray-scale bus. Therefore, the comb-tooth distributed LCD panel 20 can be driven without using a data scramble IC by driving the data lines from the first side of the LCD panel 20 (electro-optical device) based on the data (LAT1 to LAT160) held in the flip-flops of the first data latch 160 and driving the data lines from the second side of the LCD panel 20 (electro-optical device) based on the data (LAT161 to LAT320) held in the flip-flops of the second data latch 170.

It is preferable that the display driver 30 include the following shift clock generation circuit.

Figure 10:
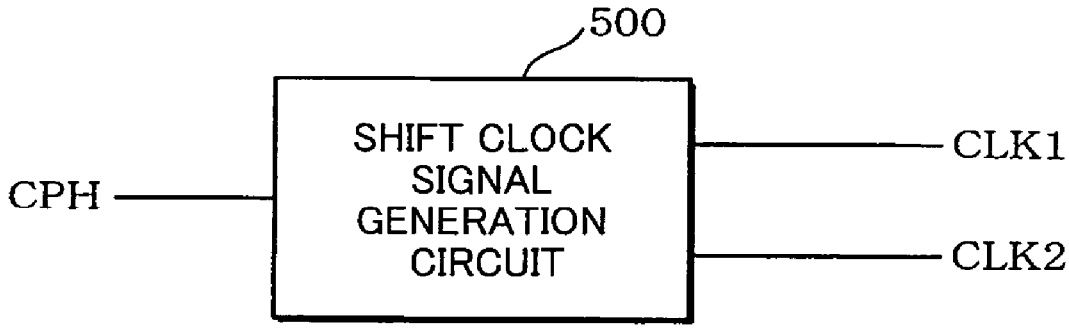
FIG. 10 is a configuration diagram of a shift clock generation circuit in an embodiment of the present invention.

FIG. 10 shows an outline of a configuration of a shift clock generation circuit. A shift clock generation circuit 500 generates the first and second shift clocks CLK1 and CLK2 based on the reference clock CPH with which the gray-scale data is supplied in synchronization. The shift clock generation circuit 500 generates the first and second shift clocks CLK1 and CLK2 so that the first and second shift clocks CLK1 and CLK2 include a period in which the phases of the first and second shift clocks CLK1 and CLK2 are reversed. This enables the first and second shift clocks CLK1 and CLK2 for obtaining the shift outputs which are generated separately to be generated by using a simple configuration.

In the shift clock generation circuit 500, the first and second shift start signals ST1 and ST2 are allowed to be signals having the same phase by generating the first and second shift clocks CLK1 and CLK2 as described below, whereby the configuration and control can be simplified.

Figure 11:
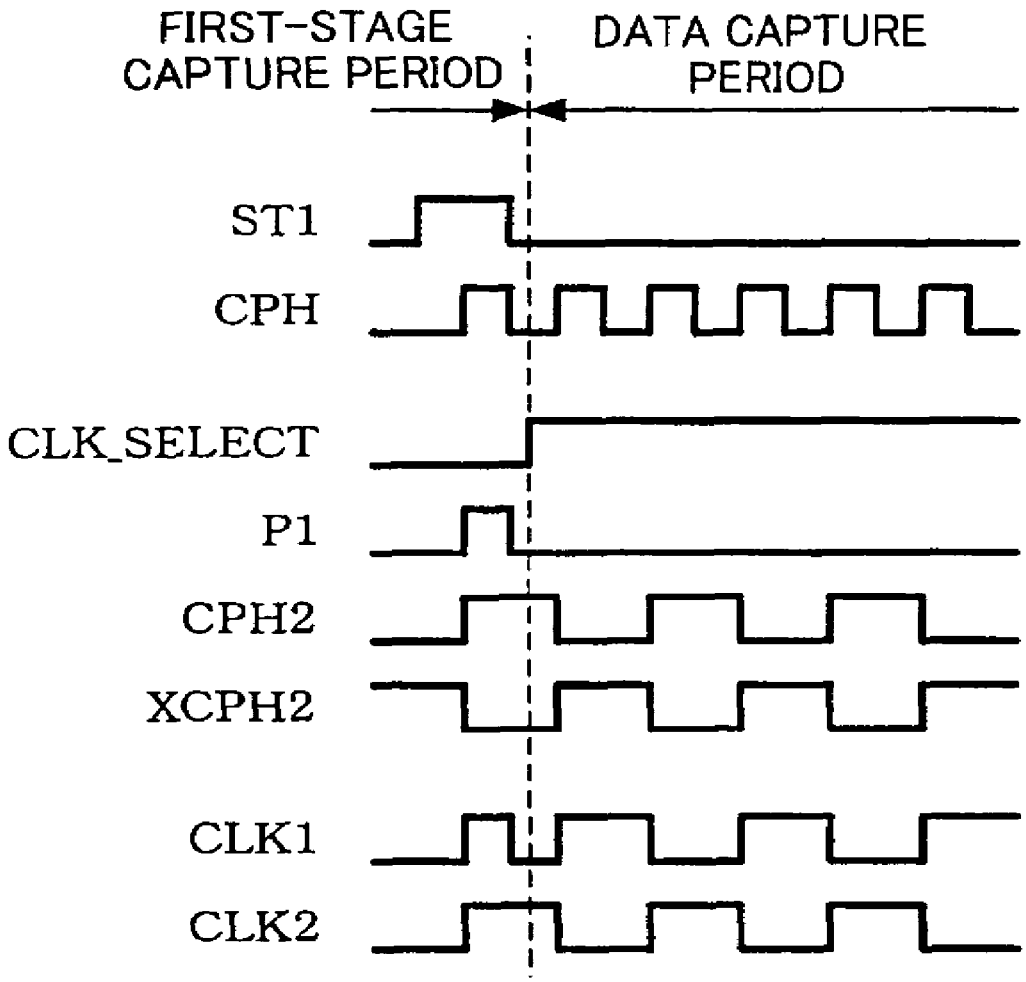
FIG. 11 is a timing diagram showing an example of generation timing of first and second reference shift clocks by a shift clock generation circuit.

FIG. 11 shows an example of generation timing of the first and second shift clocks CLK1 and CLK2 in the shift clock generation circuit 500. In order to allow the first and second shift start signals ST1 and ST2 to be signals having the same phase, it is necessary to capture the first and second shift start signals ST1 and ST2 in the first-stages of the first and second shift registers 140 and 150, respectively.

The shift clock generation circuit 500 generates a clock select signal CLK_SELECT which specifies a first-stage capture period and a data capture period (shift operation period). The first-stage capture period may be referred to as a period in which the first shift start signal ST1 is captured into the first shift register 140, or a period in which the second shift start signal ST2 is captured into the second shift register 150. The data capture period may be referred to as a period in which the shift start signals captured in the first-stage capture period are shifted after the first-stage capture period has elapsed.

The first and second shift clocks CLK1 and CLK2 are provided with edges for capturing the first and second shift start signals ST1 and ST2 by using the clock select signal CLK_SELECT.

Therefore, a pulse P1 of the reference clock CPH is generated in the first-stage capture period. A frequency-divided clock CPH2 is generated by dividing the frequency of the reference clock CPH. The frequency-divided clock CPH2 becomes the second shift clock CLK2. An inverted frequency-divided clock XCPH2 is generated by reversing the phase of the frequency-divided clock CPH2.

The first shift clock CLK1 is generated by selectively outputting the pulse P1 of the reference clock CPH in the first-stage capture period and selectively outputting the inverted frequency-divided clock XCPH2 in the data capture period by using the clock select signal CLK_SELECT.

Figure 12:
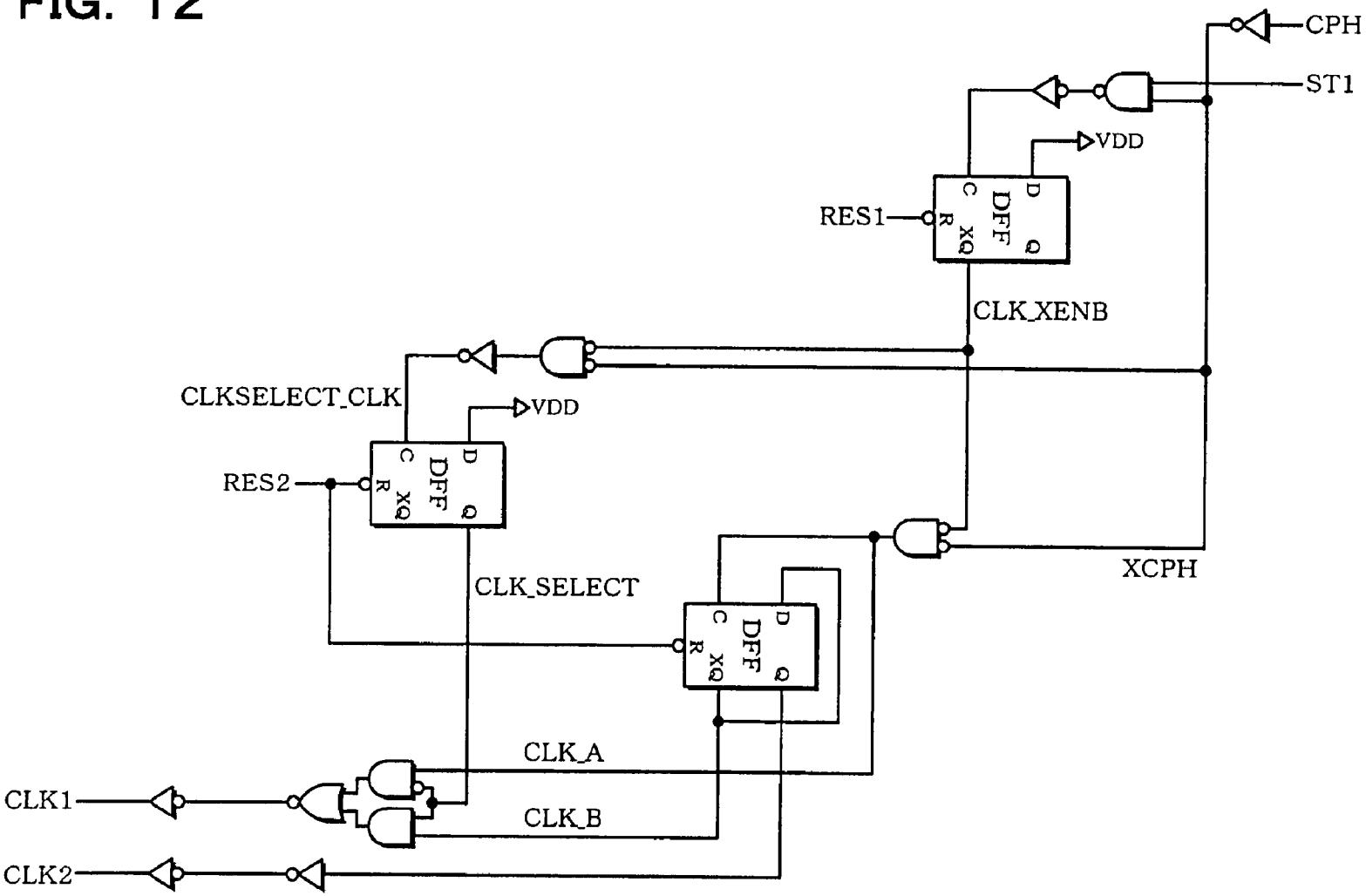
FIG. 12 is a circuit diagram showing a configuration example of a shift clock generation circuit.

FIG. 12 shows a circuit diagram which is a specific configuration example of the shift clock generation circuit 500.

Figure 13:
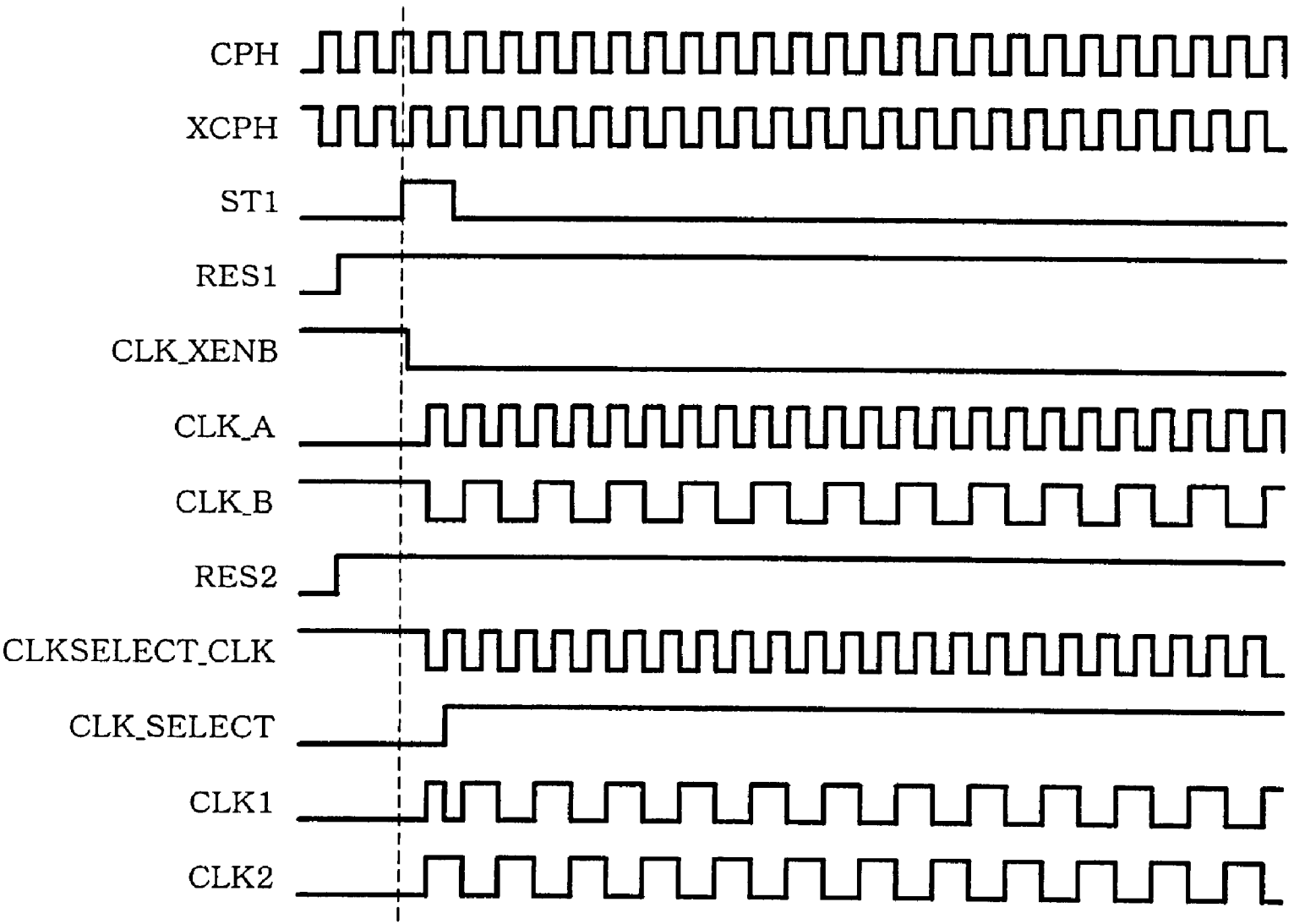
FIG. 13 is a timing diagram of an operation example of the shift clock generation circuit shown in FIG. 12.

FIG. 13 shows an example of operation timing of the shift clock generation circuit 500 shown in FIG. 12.

In FIGS. 12 and 13, clocks CLK_A and CLK_B are generated by using the reference clock CPH, and selectively output by using the clock select signal CLK_SELECT. The second shift clock CLK2 is a signal obtained by reversing the clock CLK_B. The first shift clock CLK1 is the clock CLK_A which is selectively output in the first-stage capture period in which the clock select signal CLK_SELECT is "L", and is the clock CLK_B which is selectively output in the data capture period in which the clock select signal CLK_SELECT is "H".

The operation of the data latch 100 of the display driver 30 having the above-described configuration is described below.

Figure 14:
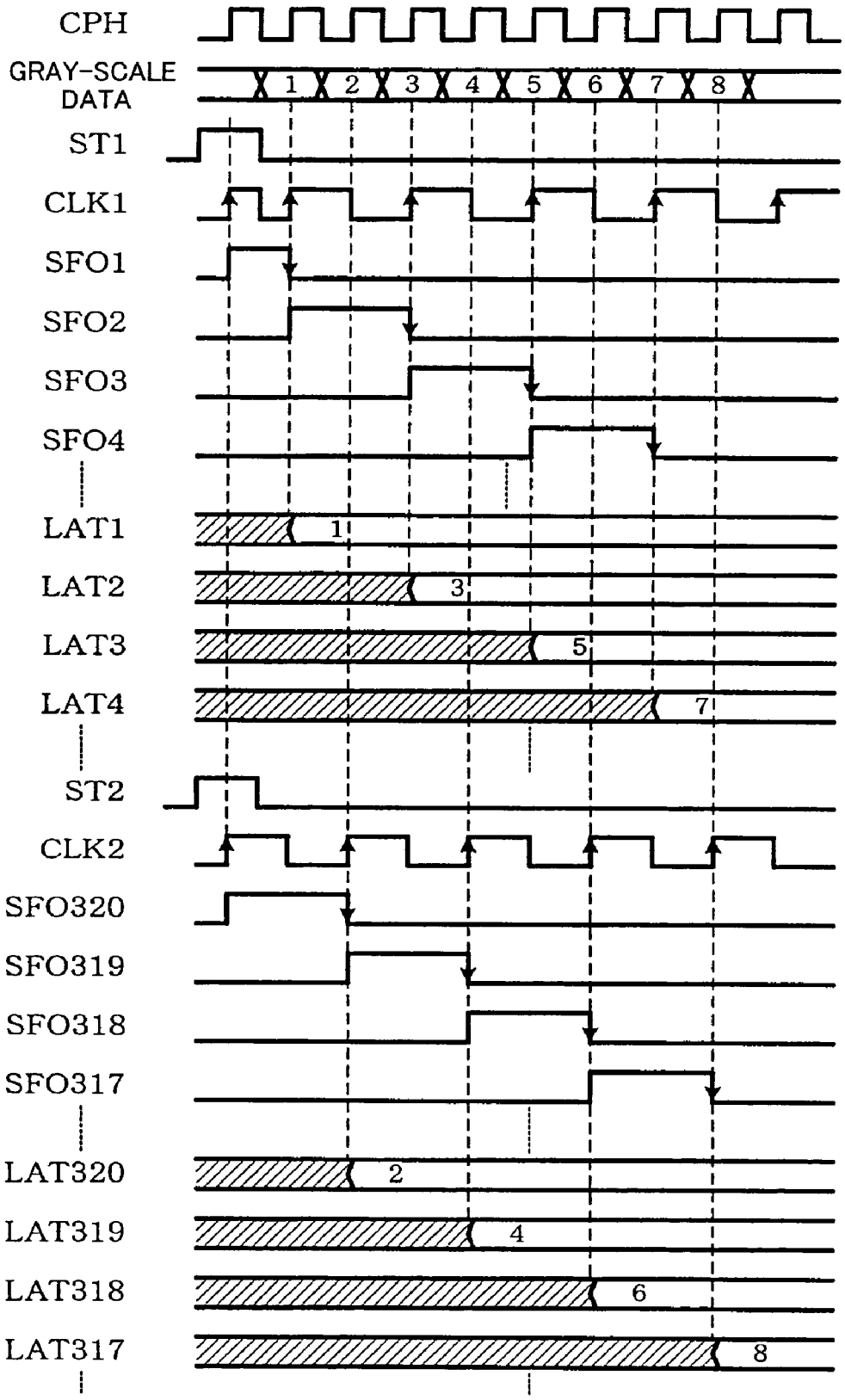
FIG. 14 is a timing diagram showing an operation example of a data latch of a display driver in an embodiment of the present invention.

FIG. 14 shows an example of an operation timing chart of the data latch 100 of the display driver 30.

In this example, the first and second shift clocks CLK1 and CLK2 are generated as shown in FIGS. 11 and 13, and the first and second shift start signals ST1 and ST2 are signals having the same phase.

The gray-scale data is supplied to the gray-scale bus 110 corresponding to the arrangement order of the data lines DL1 to DLN of the LCD panel 20. In this example, the gray-scale data DATA1 ("1" in FIG. 14) is illustrated corresponding to the data line DL1, and the gray-scale data DATA2 ("2" in FIG. 14) is illustrated corresponding to the data line DL2.

The first shift register 140 shifts the first shift start signal ST1 in synchronization with a rising edge of the first shift clock CLK1. As a result, the first shift register 140 outputs the shift outputs SFO1 to SFO160 in that order.

The second shift register 150 shifts the second shift start signal ST2 in synchronization with a rising edge of the second shift clock CLK2 during the shift operation of the first shift register 140. As a result, the second shift register 150 outputs the shift outputs SFO320 to SFO161 in that order.

The first data latch 160 captures the gray-scale data on the gray-scale bus 110 at a falling edge of each shift output from the first shift register 140. As a result, the first data latch 160 captures the gray-scale data DATA1 at a falling edge of the shift output SFO1, captures the gray-scale data DATA3 at the falling edge of the shift output SFO2, and captures the gray-scale data DATA5 at a falling edge of the shift output SFO3.

The second data latch 170 captures the gray-scale data on the gray-scale bus 110 at a falling edge of each shift output from the second shift register 150. As a result, the second data latch 170 captures the gray-scale data DATA2 at a falling edge of the shift output SFO320, captures the gray-scale data DATA4 at the falling edge of the shift output SFO319, and captures the gray-scale data DATA6 at a falling edge of the shift output SFO318.

This enables the gray-scale data after the data scramble (see FIG. 5) corresponding to each of the data lines of the comb-tooth distributed LCD panel 20 to be captured. Therefore, the gray-scale data DATA1 to DATA320 is respectively supplied to each of the data lines DL1 to DL320 of the LCD panel 20 shown in FIG. 1 or 4, whereby a correct image can be displayed.

The present invention is not limited to the above-described embodiment. Various modifications and variations are possible within the spirit and scope of the present invention. The above embodiment is described taking as an example an active matrix type liquid crystal panel in which each pixel of the display panel includes a TFT. However, the present invention is not limited thereto. The present invention can also be applied to a passive matrix type liquid crystal display. The present invention can be applied to a plasma display device in addition to the liquid crystal panel.

In the case of forming one pixel by using three dots, the present invention can be realized in the same manner as described above by replacing the data line by a set of three color component data lines.

Part of requirements of any claim of the present invention could be omitted from a dependent claim which depends on that claim. Moreover, part of requirements of any independent claim of the present invention could be made to depend on any other independent claim.

There can be provided embodiments of the present invention having features as follows.

One embodiment of the present invention relates to a display driver which drives a plurality of data lines of an electro-optical device which includes a plurality of scan lines, the data lines, a switching element connected with one of the scan lines and one of the data lines and a pixel electrode connected with the switching element, the data lines including data line groups alternately distributed from two opposite sides toward inside of the electro-optical device in a shape of comb teeth, each of the data line groups consisting of a predetermined number of the data lines, and the display driver including:

a gray-scale bus to which gray-scale data is supplied corresponding to an arrangement order of each of the data lines;

first and second clock lines to which a first and second shift clocks are supplied;

a first shift register which includes a plurality of flip-flops, shifts a first shift start signal in a first shift direction based on the first shift clock, and outputs shift output from each of the flip-flops;

a second shift register which includes a plurality of flip-flops, shifts a second shift start signal in a second shift direction opposite to the first shift direction based on the second shift clock, and outputs shift output from each of the flip-flops;

a first data latch which includes a plurality of flip-flops, each of which holds the gray-scale data corresponding to one of the data lines based on the shift output of the first shift register;

a second data latch which includes a plurality of flip-flops, each of which holds the gray-scale data corresponding to one of the data lines based on the shift output of the second shift register; and a data line driver circuit including a plurality of data output sections, each of the data output sections driving one of the data lines based on the gray-scale data held in one of the flip-flops of the first or second data latch and being disposed corresponding to the arrangement order of the data lines.

In this embodiment, the gray-scale data supplied to the gray-scale bus corresponding to the arrangement order of each of the data lines of the electro-optical device can be captured into the first and second data latches by the shift outputs based on the first and second shift clocks which can be separately set.

This enables the gray-scale data to be captured into the first and second data latches by changing the arrangement order of the gray-scale data on the gray-scale bus. Therefore, a comb-tooth distributed electro-optical device can be driven without using a data scramble IC as an additional circuit.

With this display driver, the data line driver circuit may drive the data lines from a first side of the electro-optical device based on data held in the flip-flops of the first data latch, and may drive the data lines from a second side of the electro-optical device which faces the first side based on data held in the flip-flops of the second data latch.

According to this feature, the mounting size of the comb-tooth distributed electro-optical device can be reduced by driving the data lines from the first side based on the data held in the flip-flops of the first data latch, and driving the data lines from the second side of the electro-optical device which faces the first side based on the data held in the flip-flops of the second data latch.

This display driver may include a shift clock generation circuit which generates the first and second shift clocks based on a reference clock, and a shift operation period by each of the first and second shift registers may include a period in which phases of the first and second shift clocks are reversed.

With this display driver, the first and second shift start signals may be signals having the same phase, and the shift clock generation circuit may generate the second shift clock by dividing frequency of the reference clock, and may generate the first shift clock which has a pulse in a first-stage capture period for capturing the first shift start signal into the first shift register and has a phase which is a reverse of a phase of the second shift clock in a data capture period after the first-stage capture period has elapsed.

According to these features, generation of the first and second shift clocks can be further simplified, and the first and second shift start signals may be signals having the same phase. Therefore, the configuration and control of the display driver can be simplified.

With this display driver, a direction from the first side to the second side in which the data lines extend may be the same as the first or second shift direction.

With this display driver, when the scan lines extend along a long side of the electro-optical device and the data lines extend along a short side of the electro-optical device, the display driver may be disposed along the short side.

According to these features, the mounting size of the comb-tooth distributed electro-optical device can be reduced as the number of data lines increases.

Another embodiment of the present invention provides an electronic optical device including:

a plurality of scan lines;

a plurality of data lines which includes data line groups alternately distributed from two opposite sides toward inside of the electro-optical device in a shape of comb teeth, each of the data line groups consisting of a predetermined number of the data lines;

a switching element connected with one of the scan lines and one of the data lines; and a pixel electrode connected with the switching element;

the display driver as defined in claim 1 which drives the data lines; and a scan driver which scans the scan lines.

A further embodiment of the present invention provides an electronic optical device including:

a display panel which has first and second sides facing each other and includes a plurality of scan lines, a plurality of data lines which includes data line groups alternately distributed from the first and second sides toward inside of the electro-optical device in a shape of comb teeth, a switching element connected with one of the scan lines and one of the data lines, and a pixel electrode connected with the switching element, each of the data line groups consisting of a predetermined number of the data lines;

the display driver as defined in claim 1 which drives the data lines; and a scan driver which scans the scan lines.

According to these embodiments, an electro-optical device which can be readily mounted on an electronic instrument can be provided by reducing the mounting size.

What is claimed is:

1. A display driver which drives a plurality of data lines of an electro-optical device which includes a plurality of scan lines, the data lines, a switching element connected with one of the scan lines and one of the data lines and a pixel electrode connected with the switching element, the data lines including data line groups alternately distributed from two opposite sides toward inside of the electro-optical device, each of the data line groups consisting of a predetermined number of the data lines, the display driver comprising:

a gray-scale bus to which gray-scale data is supplied corresponding to an arrangement order of each of the data lines;

first and second clock lines to which first and second shift clocks are supplied;

a first shift register which includes a plurality of flip-flops, shifts a first shift start signal in a first shift direction based on the first shift clock, and outputs shift output from each of the flip-flops;

a second shift register which includes a plurality of flip-flops, shifts a second shift start signal in a second shift direction opposite to the first shift direction based on the second shift clock, and outputs shift output from each of the flip-flops;

a first data latch which includes a plurality of flip-flops, each of which holds the gray-scale data corresponding to one of the data lines based on the shift output of the first shift register;

a second data latch which includes a plurality of flip-flops, each of which holds the gray-scale data corresponding to one of the data lines based on the shift output of the second shift register; and a data line driver circuit including a plurality of data output sections, each of the data output sections driving one of the data lines based on the gray-scale data held in one of the flip-flops of the first or second data latch and being disposed corresponding to the arrangement order of the data lines, wherein the first and second shift start signals are signals having the same phase, and wherein the first shift clock has a pulse in a first-stage capture period for capturing the first shift start signal into the first shift register and has a phase which is a reverse of a phase of the second shift clock in a data capture period after the first-stage capture period has elapsed.

2. The display driver as defined in claim 1, wherein the data line driver circuit drives the data lines from a first side of the electro-optical device based on data held in the flip-flops of the first data latch, and drives the data lines from a second side of the electro-optical device which faces the first side based on data held in the flip-flops of the second data latch.

3. The display driver as defined in claim 1, further comprising:

a shift clock generation circuit which generates the first and second shift clocks based on a reference clock, wherein a shift operation period by each of the first and second shift registers includes a period in which phases of the first and second shift clocks are reversed.

4. The display driver as defined in claim 2, further comprising:

a shift clock generation circuit which generates the first and second shift clocks based on a reference clock, wherein a shift operation period by each of the first and second shift registers includes a period in which phases of the first and second shift clocks are reversed.

5. The display driver as defined in claim 3, wherein the shift clock generation circuit generates the second shift clock by dividing frequency of the reference clock, and generates the first shift clock which has a pulse in a first-stage capture period for capturing the first shift start signal into the first shift register and has a phase which is a reverse of a phase of the second shift clock in a data capture period after the first-stage capture period has elapsed.

6. The display driver as defined in claim 4, wherein the shift clock generation circuit generates the second shift clock by dividing frequency of the reference clock, and generates the first shift clock which has a pulse in a first-stage capture period for capturing the first shift start signal into the first shift register and has a phase which is a reverse of a phase of the second shift clock in a data capture period after the first-stage capture period has elapsed.

7. The display driver as defined in claim 2, wherein a direction from the first side to the second side in which the data lines extend is the same as the first or second shift direction.

8. The display driver as defined in claim 3, wherein a direction from the first side to the second side in which the data lines extend is the same as the first or second shift direction.

9. The display driver as defined in claim 4, wherein a direction from the first side to the second side in which the data lines extend is the same as the first or second shift direction.

10. The display driver as defined in claim 5, wherein a direction from the first side to the second side in which the data lines extend is the same as the first or second shift direction.

11. The display driver as defined in claim 6, wherein a direction from the first side to the second side in which the data lines extend is the same as the first or second shift direction.

12. The display driver as defined in claim 1, wherein, when the scan lines extend along a long side of the electro-optical device and the data lines extend along a short side of the electro-optical device, the display driver is disposed along the short side.

13. The display driver as defined in claim 2, wherein, when the scan lines extend along a long side of the electro-optical device and the data lines extend along a short side of the electro-optical device, the display driver is disposed along the short side.

14. The display driver as defined in claim 3, wherein, when the scan lines extend along a long side of the electro-optical device and the data lines extend along a short side of the electro-optical device, the display driver is disposed along the short side.

15. The display driver as defined in claim 4, wherein, when the scan lines extend along a long side of the electro-optical device and the data lines extend along a short side of the electro-optical device, the display driver is disposed along the short side.

16. The display driver as defined in claim 5, wherein, when the scan lines extend along a long side of the electro-optical device and the data lines extend along a short side of the electro-optical device, the display driver is disposed along the short side.

17. The display driver as defined in claim 6, wherein, when the scan lines extend along a long side of the electro-optical device and the data lines extend along a short side of the electro-optical device, the display driver is disposed along the short side.

18. The display driver as defined in claim 7, wherein, when the scan lines extend along a long side of the electro-optical device and the data lines extend along a short side of the electro-optical device, the display driver is disposed along the short side.

19. An electro-optical device comprising:

a plurality of scan lines;

a plurality of data lines which includes data line groups alternately distributed from two opposite sides toward inside of the electro-optical device in a shape of comb teeth, each of the data line groups consisting of a predetermined number of the data lines;

a switching element connected with one of the scan lines and one of the data lines; and a pixel electrode connected with the switching element;

the display driver as defined in claim 1 which drives the data lines; and a scan driver which scans the scan lines.

20. An electro-optical device comprising:

a display panel which has first and second sides facing each other and includes a plurality of scan lines, a plurality of data lines which includes data line groups alternately distributed from the first and second sides toward inside of the electro-optical device in a shape of comb teeth, a switching element connected with one of the scan lines and one of the data lines, and a pixel electrode connected with the switching element, each of the data line groups consisting of a predetermined number of the data lines;

the display driver as defined in claim 1 which drives the data lines; and a scan driver which scans the scan lines.

* * * * *